US005608366A

United States Patent [19]

Sako

[11] Patent Number: 5,608,366

[45] Date of Patent: Mar. 4, 1997

[54] ELECTRONMAGNETIC DEVICE

[75] Inventor: Kazumi Sako, Kyoto, Japan

[73] Assignee: Omron Corporation, Kyoto, Japan

[21] Appl. No.: 399,406

[22] Filed: Mar. 6, 1995

[30] Foreign Application Priority Data

Mar. 4, 1994 [JP] Japan ..... 6-034911

[51] Int. Cl.[6] ..... H01H 51/22

[52] U.S. Cl. ..... 335/78; 335/80; 335/128

[58] Field of Search ..... 335/78–86, 124, 335/128, 130, 131

[56] References Cited

U.S. PATENT DOCUMENTS 5,117,209 5/1992 Sato ..... 335/80
5,270,674 12/1993 Nakanishi et al. ..... 335/78

FOREIGN PATENT DOCUMENTS 0197391 3/1986 European Pat. Off. .
1019383 9/1956 Germany .

OTHER PUBLICATIONS

Patent Abstracts of Japan, vol. 014, No. 229 (E–0928), 15 May 1990 & JP–A–02 (Omron Tateisi Electron Co.) 28 Feb. 1990.

Patent Abstracts of Japan, vol. 017, No. 050 (E–1314), 29 Jan. 1993 & JP–A–04 264321 (Fujitsu Ltd.) 21 Sep. 1992.

Patent Abstracts of Japan, vol. 017, No. 578 (E–1450), 20 Oct. 1993 & JP–A–05 174689 (Matsushita Electric Works Ltd.) 13 Jul. 1993.

Patent Abstracts of Japan, vol. 018, No. 091 (E–1508), 15 Feb. 1994 & JP–A–05 298996 (Matsushita Electric Works Ltd.) 12 Nov. 1993.

*Primary Examiner*—Lincoln Donovan
*Attorney, Agent, or Firm*—Fish & Richardson, P.C.

[57] ABSTRACT

A coil of an electromagnetic device is wound around a C-shaped or U-shaped section iron core. A supplementary member support a permanent magnet roughly on its center and defines an air gap between both ends of the member and both ends of the iron core. An armature is pivotally supported on the permanent magnet and has both ends adapted to alternately make and break contact with end walls of the iron core. The armature further includes magnetic circuit switching members near both of its ends, which cross the magnetic flux passing through the air gap, so that the magnetic circuit switching members are alternately brought into the air gap by pivoting the armature according to excitation and deexcitation by the coil.

8 Claims, 10 Drawing Sheets

ELECTRONMAGNETIC DEVICE

BACKGROUND OF THE INVENTION

1. Field of the Invention

The present invention relates to an electromagnetic device, and in particular to an improved electromagnetic device having a magnetic circuit with good magnetic efficiency.

2. Discussion of the Related Art

An example of a conventional electromagnetic relay is disclosed in the Japanese Laid-open Publication No. Sho 61-218025, a magnetic circuit of which is shown in FIGS. 14 to 16 for the convenience of explanation.

The conventional electromagnetic device includes a roughly U-shaped iron core 2 wound with a coil 1, a permanent magnet 3 fixing both internal ends of the core 2 in a position near and walls 2*a* and 2*b* thereof, and a front view roughly T-shaped armsture 4 pivotally supported on a central portion of an upper surface of the permanent magnet 3 for alternately contacting and walls 2*a* and 2*b* of the core 2.

When the electromagnetic device is not excited, one end 4*a* of the armature 4 is attracted by one end 2*a* of the core 2. When a voltage is applied to the coil 1 so as to produce a magnetic flux canceling a magnetic flux of the permanent magnet 3, the armature 4 swings clockwise against a magnetic force by the permanent magnet 3 so that other end 4*b* of armature 4 is attracted by other end wall 2*b* of the core 2. Even after the excitation of the relay is released, the armature 4 retains the attracted position by the magnetic force of the permanent magnet 3.

The attracting force characteristic of the conventional electromagnetic device is influenced by the magnetic flux of the permanent magnet 3 flowing through a winding center of coil 1, but roughly only a half of the magnetic flux produced by the permanent magnet 3 flows into the core 2. Accordingly, roughly only a half of magnetic energy of the permanent magnet 3 is utilized for operation of this device, resulting in a low magnetic efficiency.

SUMMARY OF THE INVENTION

It is therefore a primary object of the present invention to provide an improved electromagnetic device having a magnetic circuit with good magnetic efficiency.

Touch one this object, the present invention provides an electromagnetic device which includes a roughly U-shaped section iron core wound with a coil, a supplementary member supporting a permanent magnet approximately on the center thereof and defining an air gap between both ends of the member and both ends of the iron core, and an armature pivotally supported on the permanent magnet having both ends thereof extending to alternately make and brake contact with end walls of the core, and a magnetic circuit switching member near at least one end of the armature crossing the magnetic flux passing through the air gap, so that the magnetic circuit switching member is alternately entered into the air gap by pivoting the armature according to excitation and deexcitation by the coil.

The electromagnetic device of the present invention may be modified if desired. The iron core may have a C-shaped section with both ends thereof extending to face each other. A magnetic pole portion of the core coming into contact with the magnetic circuit switching member may be formed to be tapered. The magnetic circuit switching member may be a single member disposed only on the armature only near one end thereof, or a pair of members disposed near both ends of the armature to provide unbalanced magnetic characteristic with different configurations, largeness and magnetic characteristic. Engagement recessed portions may be disposed on the opposing faces of the magnetic polo portion of the permanent magnet, and the one end of the supplementary member forming the air gap, so that the magnetic circuit switching member have the configuration engageable with the engagement recessed portions of the iron core and the supplementary member. At least one of the magnetic circuit switching members may be made of a diamagnetic material.

Thus, according to the present invention, the magnetic circuit switching member moves up and down in accordance with the swing movement of the armature so that the direction of the magnetic flux flow can be changed.

The foregoing objectives and other advantages of the present invention will be apparent to those skilled in the art from the following detailed description taken with reference to the accompanying drawings.

DETAILED DESCRIPTION OF THE INVENTION

Figure 1:
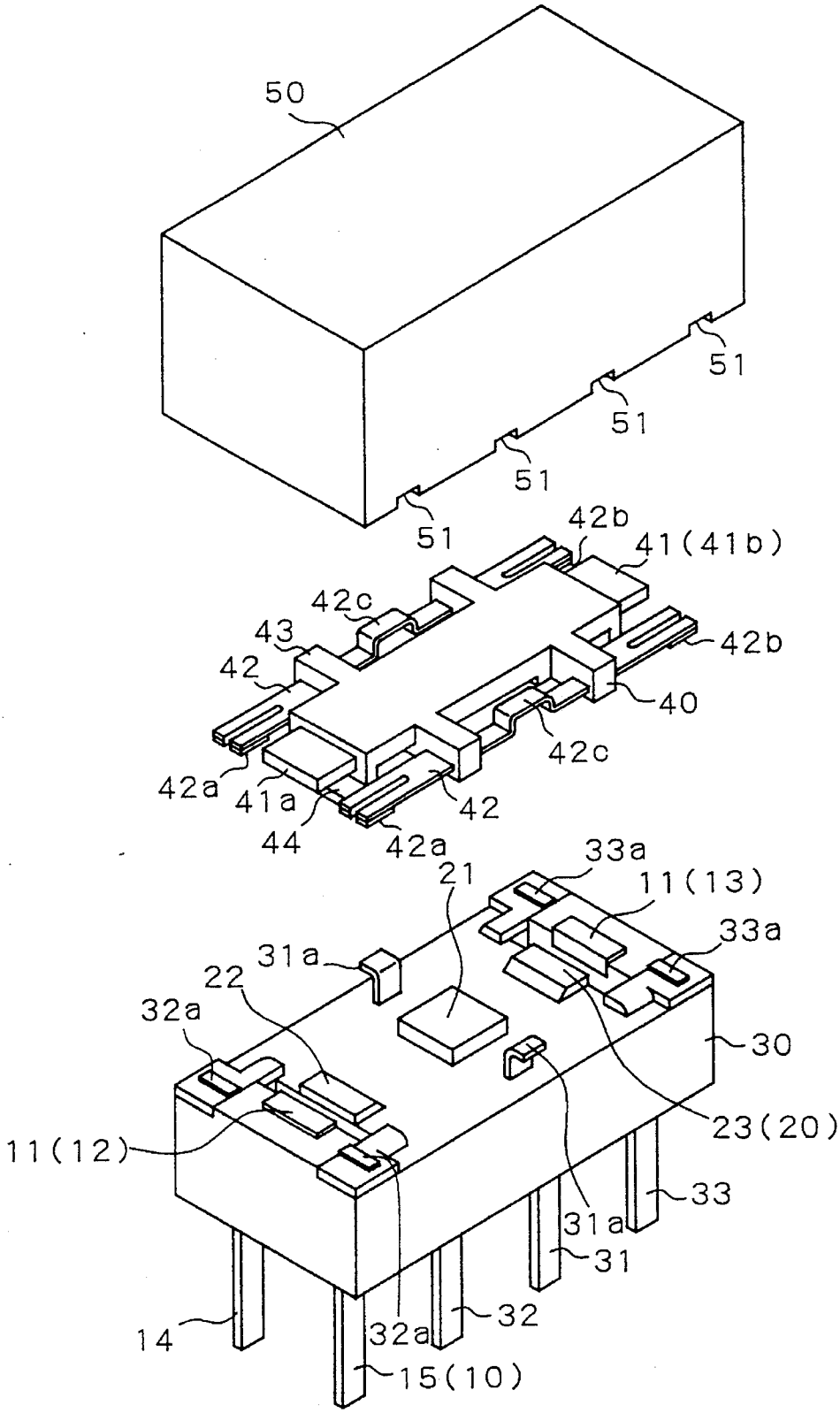
FIG. 1 is a perspective disassembled view of an electromagnetic relay as a first embodiment of the present invention.

FIGS. 1 to 9 show an electromagnetic relay as a first embodiment of the present invention employing an electromagnetic device which generally includes a base block 30 composed of an electromagnet 10 and a supplementary member 20, a movable block 40, and a housing 50.

Figure 6:
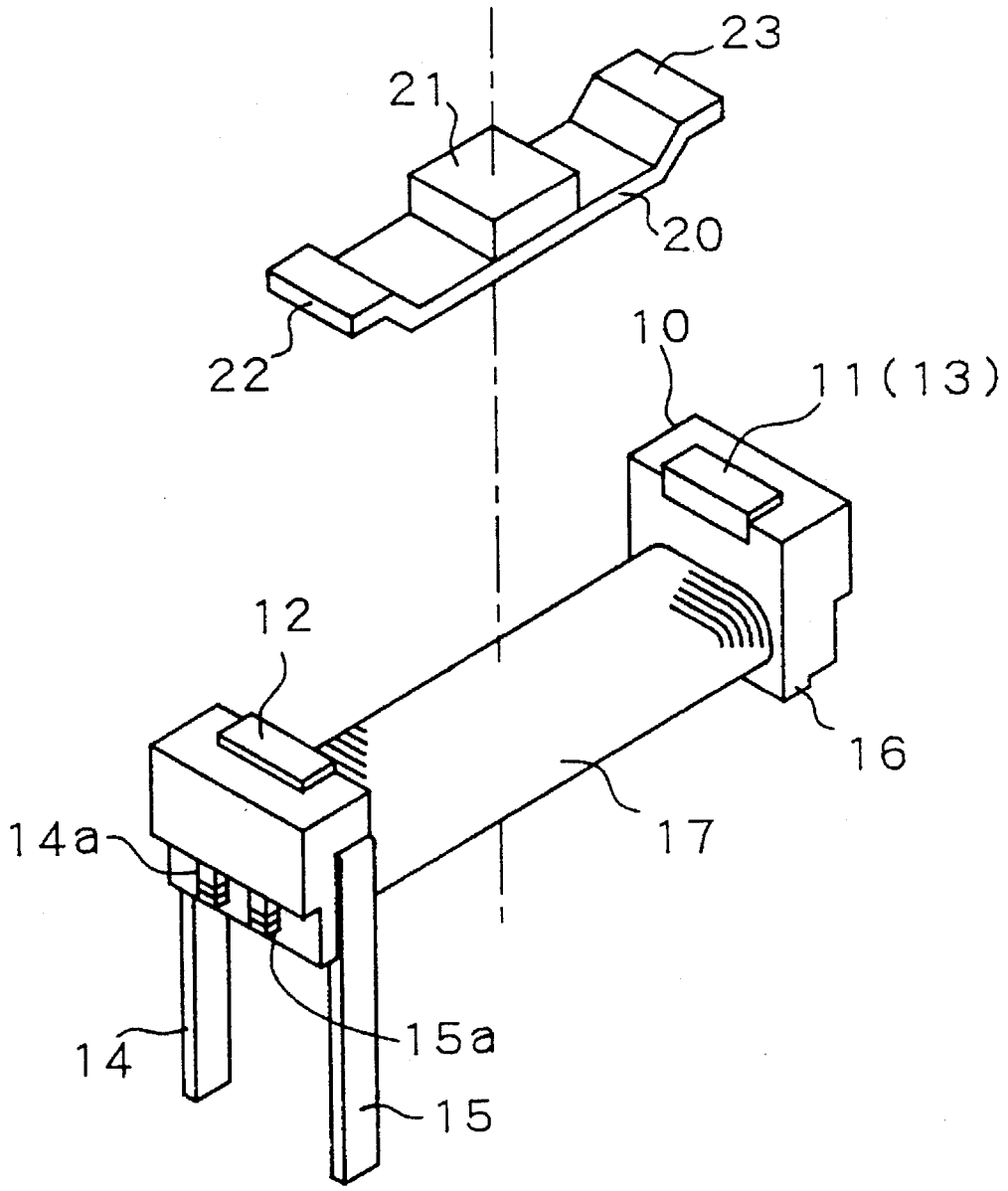
FIG. 6 is a perspective disassembled view of a main component of the relay of FIG. 2.

As shown in FIG. 6, the electromagnet 10 includes a roughly C-shaped section iron core 11 having a pair of opposing magnetic poles at both ends thereof and a pair of coil terminals 14 and 15, which are insert-molded into a spool 15, a coil 17 wound around the body of the spool 16, and a pair of coil terminals 14 and 15 having laps 14*a* and 15*a* wrapped with leads of the coil 17 and soldered. The C-shaped section configuration of the iron core 11 allows the magnetic flux to be concentrated for increasing the magnetic flux density, resulting in the increase of the magnetic efficiency.

The supplementary member 20 includes a rectangular iron strip which is bent by press processing, and a permanent magnet 21 fixed on a center of an upper wall of the strip.

As shown in FIG. 1, the base block 30 is formed integral with the electromagnet 10 and the supplementary member 20 by secondary molding, and insert-molded with common terminals 31 and stationary terminals 32 and 33.

The common terminals 31 have connection ends 31*a* at upper ends thereof exposed from middle edges of the base block 30, and the stationary terminals 32 and 33 have stationary contacts 32*a* and 33*a* at upper ends thereof exposed from upper corners of the base block 30. FIG. 1 does not show the common terminal 31 and stationary terminals 32 and 33 on the back side of the base block 30.

Figure 7:
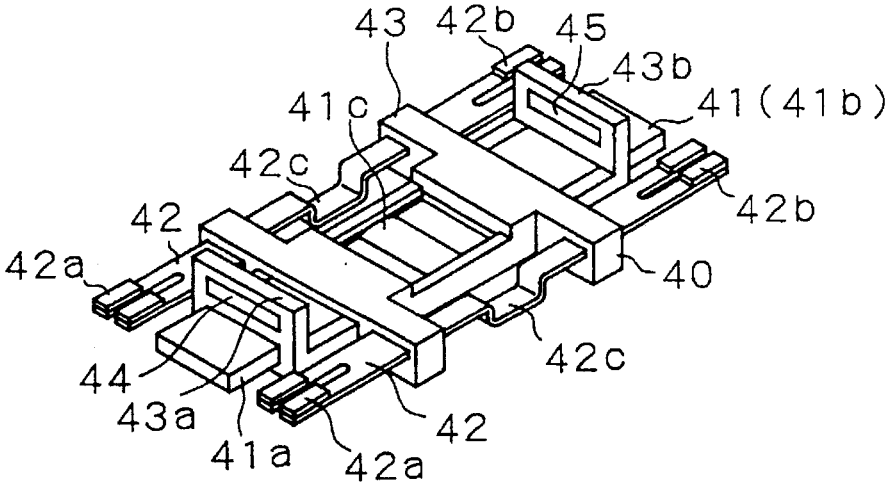
FIG. 7 is a perspective view of a movable block employed in the relay of FIG. 1 from an opposite direction.

As shown in FIGS. 1 and 7, the movable block 40 includes an armature 41 and a pair of movable contact blades 42 in parallel with both sides of the block, which are formed integral with a connector mold 40. The armature 41 includes a semicircle section projection 41*c* at a middle of the lower wall thereof. The movable contact blades 42 respectively includes movable contacts 42*a* and 42*b* on lower surfaces of both ends thereof and are bent upwardly at the middle portions 42*c* thereof, respectively. The connector mold 43 includes a pair of projections 43*a* and 43*b* inserted by soft magnetic members 44 and 45 extending downwardly of a lower surface and both ends thereof.

The base block 40 is provided with a permanent magnet 21 projecting from an upper surface thereof on which the projection 41*c* of the armature 41 is put, and the connection ends 31*a* of common terminals 31 are fixed to the middle portions 42*c* of the movable contact blades 42 by welding to form a single unit, so that the movable block 40 is swingably or pivotally supported by the movable block 40. Thus, both ends 41*a* and 41*b* of the armature 41 opposed the magnetic poles 12 and 13 of the iron core 11 for alternately making and breaking contact therebetween so that the movable contacts 42*a* and 42*c* oppose the stationary contacts 33*a* and 22*a* for alternately making and breaking contact therebetween. The soft magnetic members 44 and 45 of the movable block 40 are positioned to be brought into and moved out of the gaps between the magnetic poles 12 of the core 11 and one end 22 of the supplementary iron strip 20 and between the magnetic pole 13 of the iron core 11 and the opposite end 23 of the supplementary iron strip 20.

The housing 50 has a box-shaped configuration for engagement with the base block 30 mounted by the movable block 40, and its opening edge is provided with a plurality of cut portion 51 for engagement with the terminals 15, 31, 32, and 33 at the middle portions thereof in the same pitches as those of the terminals.

Figure 2:
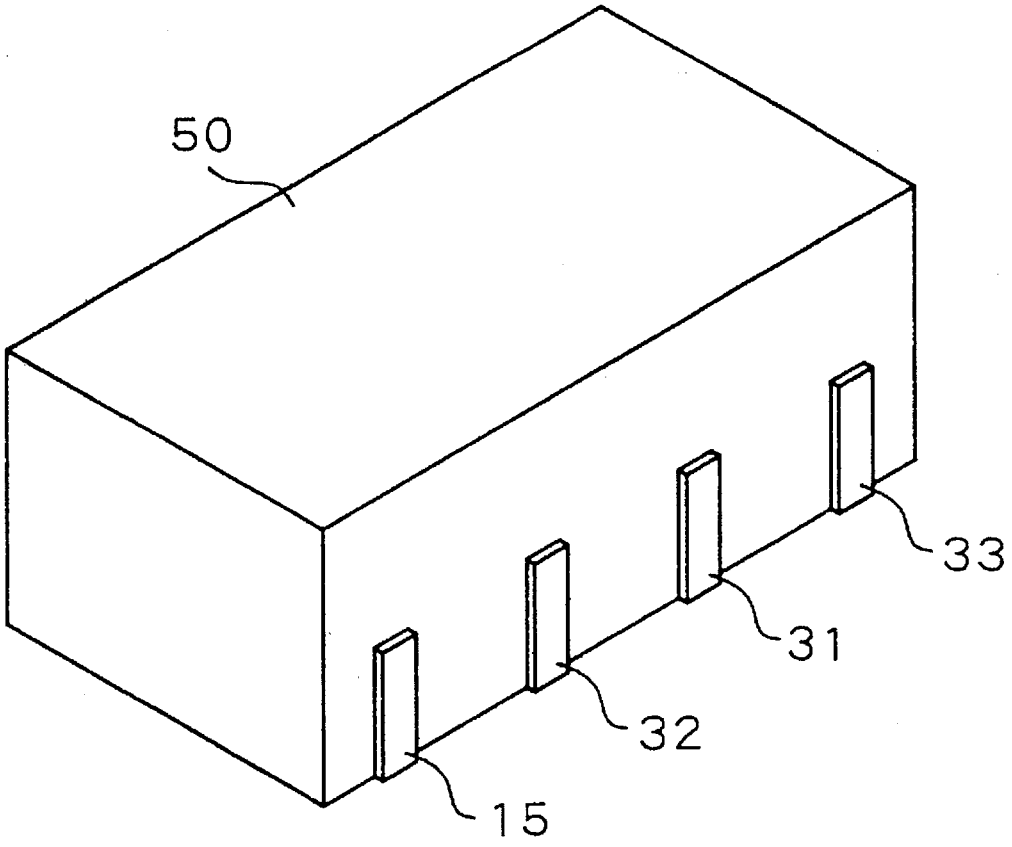
FIG. 2 is a perspective assembled view of the electromagnetic relay of FIG. 1.
Figure 3:
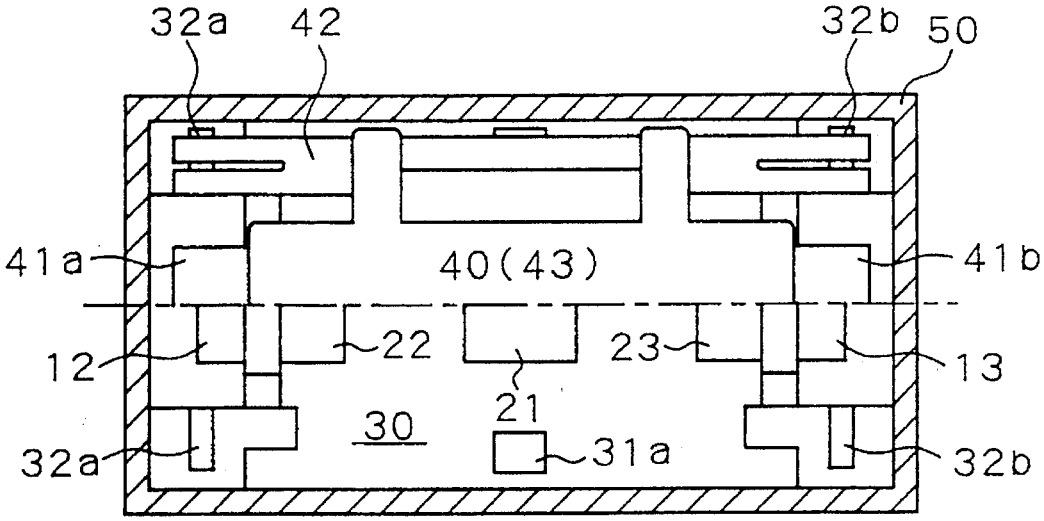
FIG. 3 is a plan cross-sectional view, partially cut away, of the relay of FIG. 2.
Figure 4:
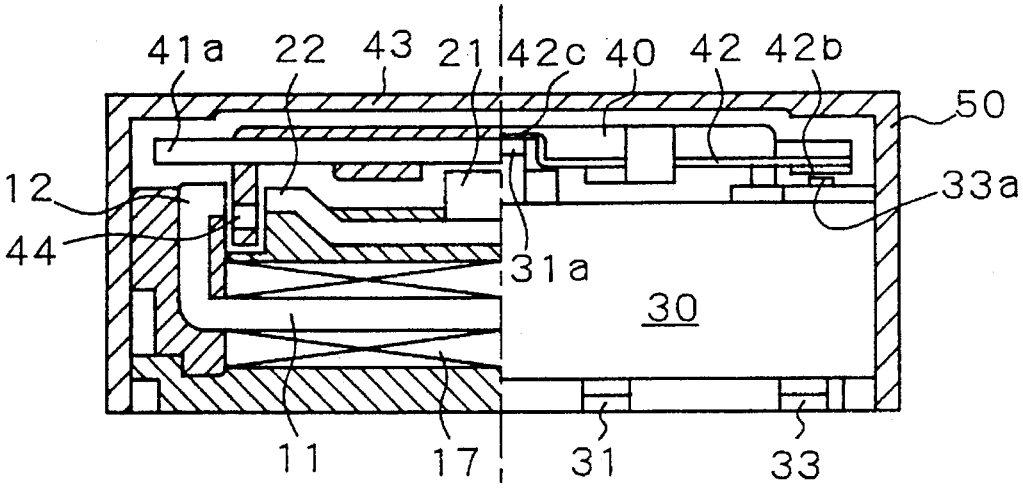
FIG. 4 is a front cross-sectional view partially cut away, of the relay of FIG. 2.
Figure 5:
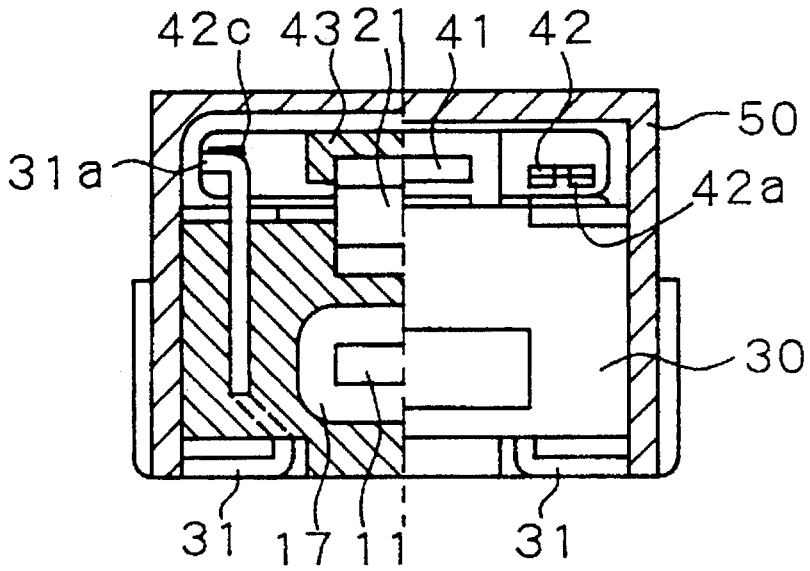
FIG. 5 is a left side cross-sectional view partially cut away, of the relay of FIG. 2.

After the housing 50 is fitted to the base block 30 mounted by the movable block 40, a bottom wall of the base block 30 is filled with a sealing material (not shown in the drawings) to be hardened and the terminals 15, 31, 32 and 33 are bent upwardly as shown in FIG. 2 to complete the assembly.

Figure 8:
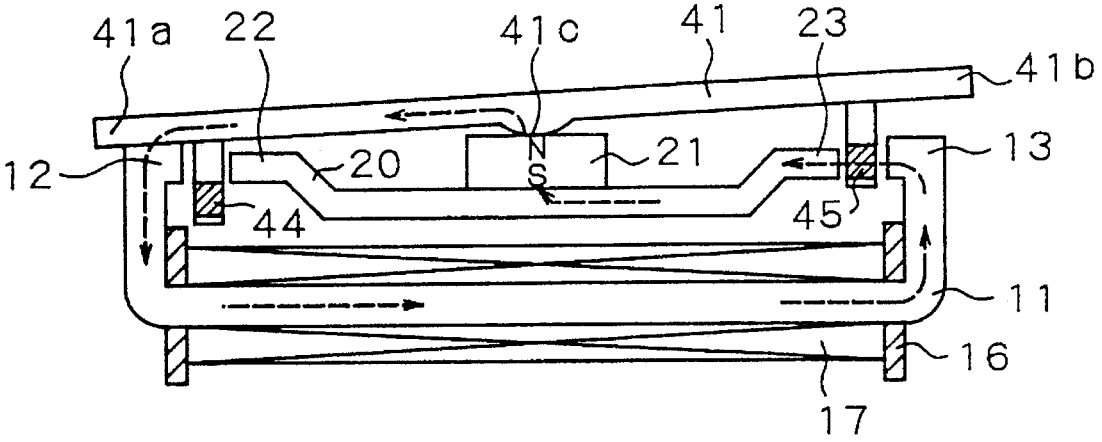
FIG. 8 is a schematic view of a magnetic circuit of the relay of FIG. 1.

When thus constructed electromagnetic relay is not energized, one and 41*a* of the armature 41 is attracted by the magnetic pole 12 of the iron core 11 as shown in FIG. 8 so that the movable contact 42*a* is brought into contact with the stationary contact 32*a* and soft magnetic member 45 is seated within the air gap between the magnetic pole 13 of the iron core 11 and the opposite end 23 of the supplementary member 20 to retain clearance therebetween. Accordingly, the magnetic flux generated from the permanent magnet 21 passes through the magnetic pole 12 of the iron core 11 from the projection 41*b* of the armature 41, and further passes through the opposite end 23 of the supplementary iron strip 20 via magnetic pole 13 and the soft magnetic member 45 to produce a magnetic loop as shown by a dotted line in FIG. 8. Thus, when the electromagnetic device of FIG. 8 is not energized, the magnetic energy of the permanent magnet 21 is utilized 100 percent because a single magnetic loop is made. Accordingly, an improved electromagnetic device with a high magnetic efficiency is provided.

Figure 9:
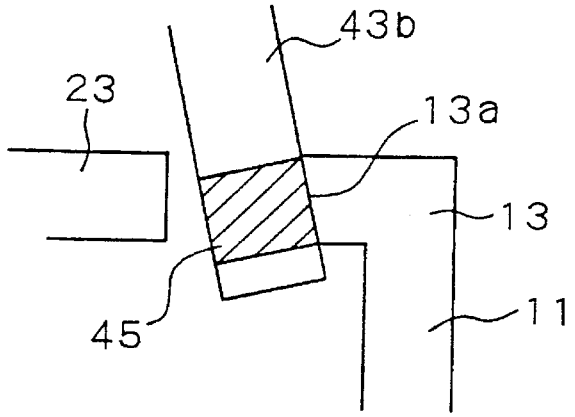
FIG. 9 is an enlarged view of a slightly modified part of the relay of FIG. 8.

As shown is FIG. 9, the iron core 11 may be modified to have a tapered face 13*a* at the magnetic pole 13 to make a face contact with the soft magnetic member 45, if desired. The tapered surface 13*a* advantageously enables the decrease of the magnetic resistance and enhancement of the magnetic efficiency.

As a voltage is applied to the coil 17 to produce the magnetic flux in a direction to deny the magnetic flux from the permanent magnet 21, the armature 41 pivots around the projection 41*c* serving as a fulcrum against the magnetic force by the permanent magnet 21 so that the member 45 leaves the gap between the magnetic pole 13 of the iron core 11 and the opposite end 23 but the soft magnetic member 44 is brought into the gap between the magnetic pole 12 of the iron core 11 and one end 22 of the supplementary member 20 so that the opposite end 41*b* of the armature 41 is attracted to the magnetic pole 13 of the iron core 13.

Accordingly, the magnetic flux generated from the permanent magnet 21 passes through the magnetic pole 13 of the iron core 11 from the projection 41*c* of the armature 41, and further passes through the one end 22 of the supplementary iron strip 20 via magnetic pole 12 and the soft magnetic member 44 to produce a magnetic loop. Thus, when the magnetic relay is energized, the magnetic energy of the permanent magnet 21 is utilized substantially 100 percent because only single magnetic loop is made. Accordingly, whenever the electromagnetic device of this embodiment is energized or not energized, it can have a high magnetic efficiency because of 100 percent utilization of the magnetic energy of the permanent magnet 21.

As the armature 41 pivots or moves clockwise in FIG. 8, the movable block 40 also pivots and the movable contact 42*b* is brought into contact with the stationary contact 33*a* after the movable contact 42*a* is separated away from the stationary contact 32*a*.

As the above mentioned excitation is released, the movable block 40 pivots in a reverse direction by a spring force of the movable contact blades 42 to return to its original position.

Figure 10:
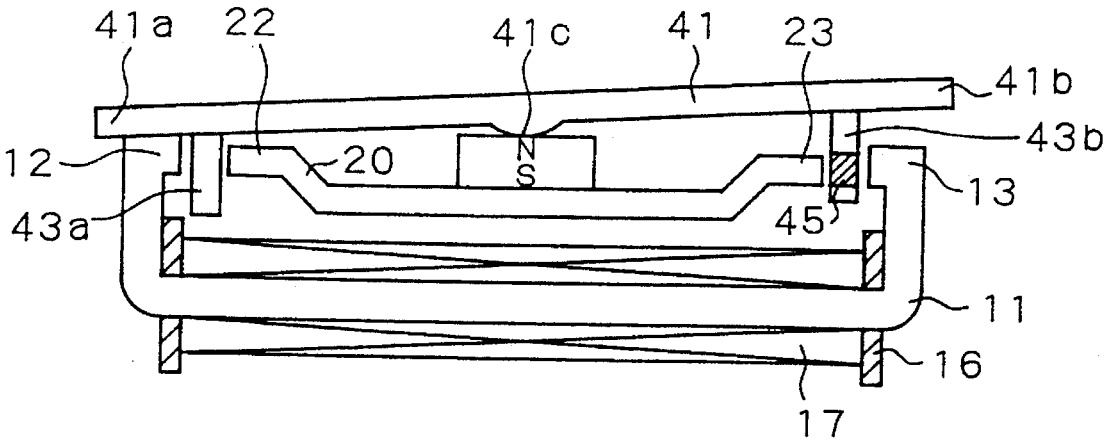
FIG. 10 is a schematic view of an electromagnetic device as a second embodiment of the present invention.

In FIG. 10, there is shown a electromagnetic relay as a second embodiment of the present invention. Though the electromagnetic relay of the foregoing first embodiment is a golf return type relay in which the downward projections 43*a* and 43*b* of the movable block 40 are insert-molded with the same characteristic soft magnetic members 44 and 45 and the movable block 40 is returned into its original position by the spring force of the movable blades 42, the relay of this second embodiment is constructed such that only one downward projection 43*b* is insert-molded with the soft magnetic member 45. Other components are the same as those of the first embodiment and its explanation is omitted for a simplified explanation. According to this second embodiment, there is disposed only soft magnetic member 45 to make the magnetic balance unbalanced for obtaining a preferred attracting force curve with increasing the degree of freedom of the design.

Figure 11:
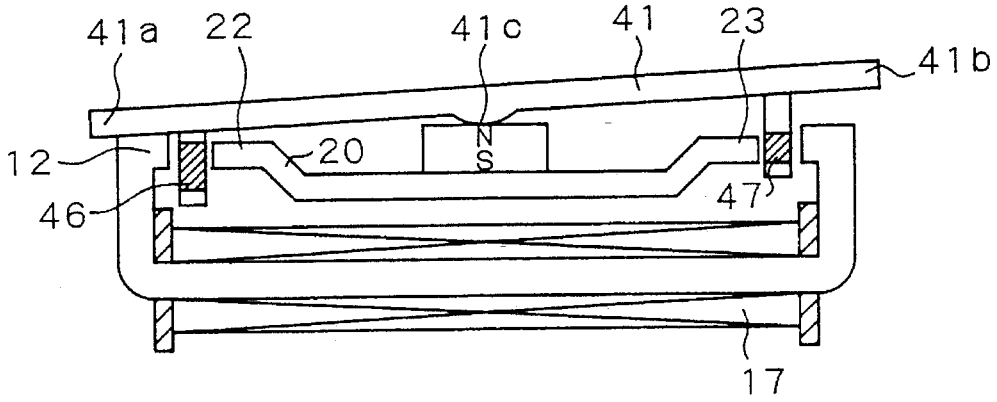
FIG. 11 is a schematic view of an electromagnetic device as a third embodiment of the present invention.

In FIG. 11, there is shown an electromagnetic relay as a third embodiment of the present invention, in which downward projections 43*a* and 43*b* of the movable block 40 have physically different soft magnetic members 46 and 47 about at least one of configurations, magnetic characteristic and size to provide a magnetic unbalance. Other components are the same as those of the above mentioned embodiments and its explanation is omitted for a simplified explanation. According to this embodiment, a preferred attraction force characteristic can be obtained by controlling the degree of unbalance of the magnetic balance.

Figure 12:
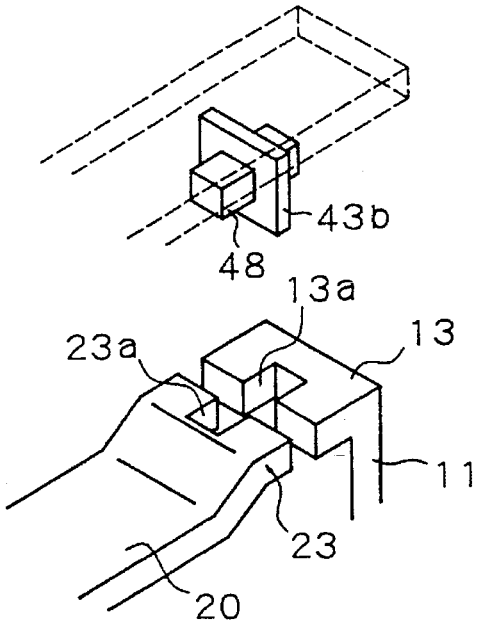
FIG. 12 is a schematic view of an electromagnetic device as a fourth embodiment of this invention.

In FIG. 12, there is shown an electromagnetic relay as a fourth embodiment of the present invention, in which a prism-shaped soft magnetic member 48 is coupled to movable block 40 though the plate shaped soft magnetic members are employed to be coupled with the movable block in the above embodiments. Accordingly, there are respectively disposed a pair of recessed portions 13*a* and 23*a* on top surfaces of the magnetic pole 13 of the iron core 11 and the opposite end 23 of the supplementary member 20 for engagement with the soft magnetic member 48. In this embodiment, the opposing areas of the member 48 to the iron core 11 and the supplementary member 20 are further enlarged, resulting in the reduction of magnetic resistance and the improved magnetic efficiency.

Figure 13:
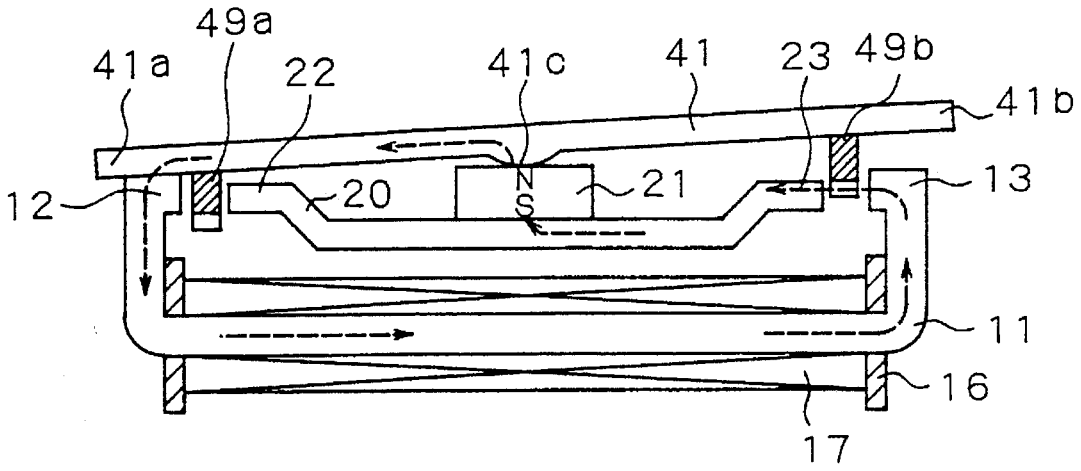
FIG. 13 is a schematic view of an electromagnetic device as a fifth embodiment of the present invention.
Figure 14:
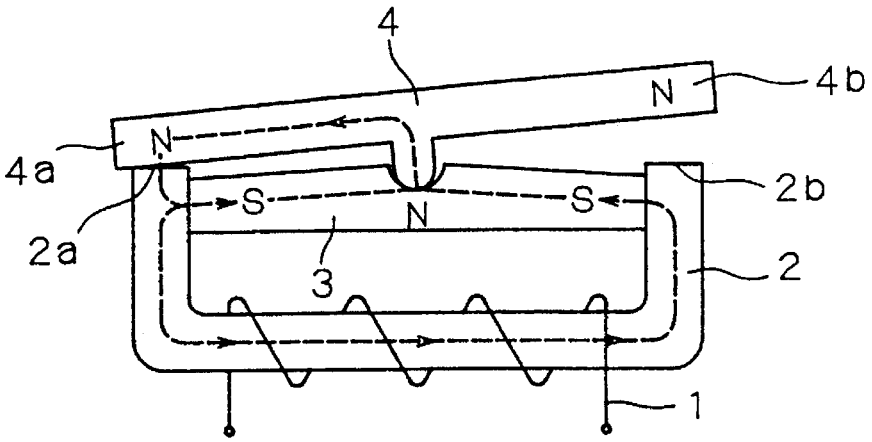
FIG. 14 is a schematic view of a magnetic circuit of a conventional electromagnetic device not excited.
Figure 15:
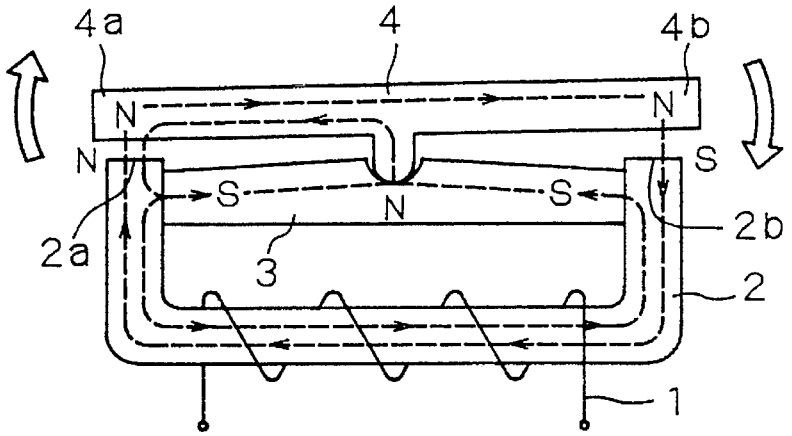
FIG. 15 is a schematic view of a magnetic circuit of a conventional electromagnetic device on excitation.
Figure 16:
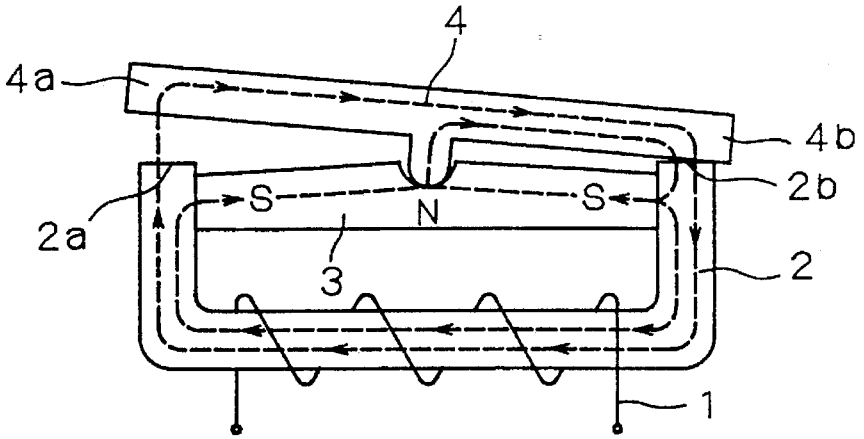
FIG. 16 is a schematic view of a magnetic circuit of a conventional electromagnetic device in an attracted position.

In FIG. 13, there is shown an electromagnetic relay as a fifth embodiment of the present invention. Though the projections 43*a* and 43*b* of the movable block 40 are inserted by the soft magnetic members in the above-mentioned embodiments, superconductive material members 49*a* and 49*b* being a diamagnetic material are employed to be inserted into the projections 43*a* and 43*b*. According to this embodiment, the magnetic flux generated from the permanent magnet 21 passes through the magnetic pole 12 of the iron core 11 from the projection 41*c* of the armature 41, and further passes through the opposite end 23 of the supplementary iron strip 20 via the air gap from the magnetic pole 13 to produce a single magnetic loop. Such a single magnetic loop is ensured in this embodiment because either the diamagnetic material member 48*a* or 49*b* serving as the magnetic circuit switching member of this embodiment blocks any magnetic flux of the permanent magnet 21 directed to the gap when it is seated in the gap.

Thus, the magnetic energy of the permanent magnet 21 is utilized substantially 100 per cent, whereby an improved magnetic relay with a high magnetic efficiency is provided.

The above-mentioned embodiments employ self-return type electromagnetic relays. However, the present invention is not limited to the embodiments and may employ a self-keep type of an electromagnetic relay by choosing a spring force in the movable contact blades, and the configurations, size, positions for mounting, and magnetic characteristic of the magnetic circuit switching member, and so forth.

While the invention has been described and illustrated with respect to certain embodiments which give satisfactory results, it will be understood by those skilled in the art, after understanding the purpose of the invention, that various other changes and modifications may be made without departing from the spirit and scope of the invention, and it is therefore, intended in the appended claims to cover all such changes and modifications.

What is claimed is:

1. An electromagnetic device comprising:

a U-shaped section iron core wound with a coil, a supplementary member supporting a permanent magnet on a center thereof, and defining an air gap between both ends of said member and both ends of said iron core, and an armature pivotally supported on said permanent magnet having both ends thereof extending to alternately make and break contact with end walls of said iron core, and a magnetic circuit switching member near at least one end of said armature crossing the magnetic flux passing through said air gap, so that said magnetic circuit switching member is brought into or moved out of said air gap by pivoting said armature according to excitation or deexcitation of the coil.

2. An electromagnetic device, comprising:

an iron core having a C-shaped section wound with a coil, said C-shaped section being formed with both ends thereof extending to face each other, the uppermost portion of the extension further extending inward;

a supplementary member supporting a permanent magnet on a center thereof, and defining an air gap between both ends of said member and both ends of said iron core, and an armature pivotally supported on said permanent magnet having both ends thereof extending to alternatively make and break contact with end walls of said iron core, and a magnetic circuit switching member near at least one end of said armature crossing the magnetic flux passing through said air gap, so that said magnetic circuit switching member is brought into or moved out of said air gap by pivoting said armature according to excitation or deexcitation of the coil.

3. An electromagnetic device according to claim 1 or 2, in which a magnetic pole portion of said iron core to be contacted by said magnetic circuit switching member has a tapered surface.

4. An electromagnetic device according to claim 1 or 2, in which said magnetic circuit switching member is disposed only near one end of said armature.

5. An electromagnetic device according to claim 1 or 2, in which a magnetic circuit switching member is disposed near each end of said armature, each of said magnetic switching members having a different magnetic characteristic due to one of a different size and configuration.

6. An electromagnetic device according to claim 1, in which engagement recessed portions are formed in respective opposing faces of one magnetic pole portion of said iron core and one end of said supplementary member, so that said magnetic circuit switching member is engageable with said engagement recessed portion in the iron core and said respective engagement recessed portion in the supplementary member.

7. An electromagnet device according to claim 1, in which the magnetic circuit switching member is made of a diamagnetic material.

8. An electromagnet device according to claim 1, in which said magnetic circuit switching member is formed integral with said armature.

* * * * *